US006022001A

United States Patent [19]

Palacio et al.

[11] Patent Number: 6,022,001

[45] Date of Patent: Feb. 8, 2000

[54] LIGHTWEIGHT JACK

[75] Inventors: Joseba Palacio, Santurtzi; Iñaki Alapont, Algorta-Gexto, both of Spain

[73] Assignee: Batz, S. Coop. Ltda., Igorre, Spain

[21] Appl. No.: 09/098,382

[22] Filed: Jun. 17, 1998

[30] Foreign Application Priority Data

Jun. 19, 1997 [ES] Spain ..... 9701339

[51] Int. Cl.[7] ..... B66F 3/12

[52] U.S. Cl. ..... 254/126

[58] Field of Search ..... 254/DIG. 1, DIG. 4, 254/122, 124, 126, 133

[56] References Cited

U.S. PATENT DOCUMENTS 5,516,066 5/1996 Fabiano et al. ..... 254/126

5,782,456 7/1998 Brosius et al. ..... 254/126

5,782,457 7/1998 Palacio ..... 254/126

*Primary Examiner*—Robert C. Watson

*Attorney, Agent, or Firm*—Browdy and Neimark

[57] ABSTRACT

A lightweight vehicle jack of the "Y" type includes aluminum, particularly in the arm (2) and the central body of the device (1). A gripping device (7) provides a larger surface area to take the edge of the body of the vehicle. On the side to which the nut (4) is fitted, the body of the device (2) has lateral reinforcing vertical ribs at 90 degrees, and there is an L-shaped internal reinforcement device (20) between the gripper (7) pivot and the pivot of the shaft of the bar (5), to reduce the thickness of the arm (1). The support base controls the body's passage to the interior of the jack.

12 Claims, 3 Drawing Sheets

LIGHTWEIGHT JACK

FIELD OF THE INVENTION

This invention is a lightweight jack of the type known as "Y" jacks, specially designed for raising vehicles, with a support base and an arm with a rotating connection to this body. Both the body and the base are connected at their upper ends by a threaded spindle passing through a nut on the body and a bar on the arm. The spindle features a crank winding handle which, when rotated, causes the spindle to turn, which in turn causes the gripper on the upper end of the arm taking the edge of the vehicle's body to move up or down in accordance with the direction taken by the crank winding handle.

REVIEW OF THE RELATED TECHNOLOGY

There is a clear tendency within industry nowadays towards reducing the weight of these types of jack, so that this has less influence on the total weight of the vehicle, thus allowing speed to be controlled and energy consumption reduced . . . etc., and for this reason they are manufactured in light materials such as aluminum.

However, existing lightweight jacks of this type normally have one disadvantage in that the thicknesses of their components are considerable, in order to provide the device with sufficient strength.

SUMMARY OF THE INVENTION

One feature of this invention is that it is a lightweight jack with normal reduced-thickness components with no loss of strength.

Another feature of the invention is that it is a lightweight jack with better control of the support base over the body of the device.

Another feature of the invention is that it is a lightweight jack with a gripper to take the edge of the body of the vehicle, which has a larger support surface area for this edge, and also provides a perfect fit on the flanges of the body in the folded position, thus preventing noise.

Another feature of the invention is that it is a lightweight jack with a built-in bar, thus eliminating the need for additional parts.

Finally, another feature of the invention is that it is a lightweight jack which allows reasonable maintenance of the cost of the unit, despite the quality and hence the price of the aluminum used to make it.

In order to meet these objectives, the invention is presented as a lightweight jack with a floor base support featuring projections facing downwards from the base to make contact with the floor. There is also another centered crosswise projection to restrict rotation of the body on the base, which has a vertical cross wall fairly parallel to the above-mentioned projection, located on the other side of the rotation plane of the body over the base with respect to the projection. This crosswise wall is of variable height, and its length is such that it is cut off at a certain distance from the flanges above the base's U-section, creating two spaces between its ends and the flanges.

These spaces connect with the thicknesses of the jack's body, and thus the jack is completely controlled with regard to its movements with respect to the base and vice-versa.

The jack body has two opposing drill holes for connection to the base on its lower end, on the same side as the support base, whilst its upper end features the nut through which the spindle passes. This housing is determined by two opposing gaps in the flanges of the U-section.

The invention features two vertical and parallel flanges with an L-shaped cross section on the exterior facade of the body, perpendicular to its lengthwise axis and opposite it. The flanges are in themselves two extremely important reinforcement devices for this area, which is subjected to considerable stress.

It should be mentioned at this point, for relevant purposes which shall be mentioned below, that the above-mentioned flanges may be set at an incline.

On the jack arm with the gripper, an important feature of the invention is an internal reinforcement device between the gripper and the nut through which the spindle passes. This internal reinforcement, which may be of any geometric shape, is in a fixed position between the flanges of the jack arm, thus maintaining rigid this section, which is an area of substantial mechanical liability, in such a fashion that it allows the thickness of the arm to be kept at normal and reasonable values.

Preferably, although not necessarily, the reinforcement device has an elbow profile and a U-shaped central cross section, with two pairs of perforated flanges with aligned drill holes at its free ends. The holes are for the gripper's cross shaft and that of the bar, respectively.

This reinforcement device may be steel or aluminum, in accordance with advisable practice for each situation, and in either format the above-mentioned objective shall be met.

The invention's bar has one specific feature, which is to prevent the arrangement of auxiliary cylinders to allow passage for the spindle. Thus it is the traditional U-shape, and facing outwards on its base there is a centered projection neck of sufficient length to connect with this spindle.

Furthermore, the flanges of the bar in question have two interaligned windows or undercuts parallel to the two normal drill holes with supporting pins placed in the direction of the flanges on the arm of the device.

Thus the weight of the bar is lessened without losing any of its strength.

The gripper in this invention is of the general type described in the application for European Patent 97500009.2 made by the applicant for this invention, the support surface area for which on the lower edge of the vehicle's body has been increased.

One of the characteristics of this gripper device is two fins which begin in the area around the theoretical longitudinal axis, not far from the outermost end or facade. Both fins have drill holes and fold on a horizontal plane over the above-mentioned longitudinal axis to lie parallel with their holes aligned, completely below the upper surface of the gripper which connects with the body of the vehicle, thus, obviously, increasing the effective surface area of same.

Moreover, on the outside and as a continuation of these fins, the device features a projection or prolongation which constitutes a gripping fin. This lies on another plane, parallel to the direction taken by the drill holes belonging to the fins dealt with in the previous paragraph.

This gripping fin has the particular advantage that when the jack is in the folded position, it meets the edge of the jack body together with the double grip of the body of the gripper, and so there is a three-point gripping contact for a perfect attachment to prevent noises which are all too common in such devices.

As an alternative construction, it should be mentioned for any relevant purposes that there is a possibility of constructing two gripping fins, one on either side of the gripper's longitudinal axis. This variation provides a totally symmetrical gripper with respect to its longitudinal axis.

BRIEF DESCRIPTION OF THE DRAWING

By way of a guide, the drawings attached shall include all details concerning the invention, and show the following.

DETAILED DESCRIPTION OF THE PREFERRED EMBODIMENT

Figure 1:
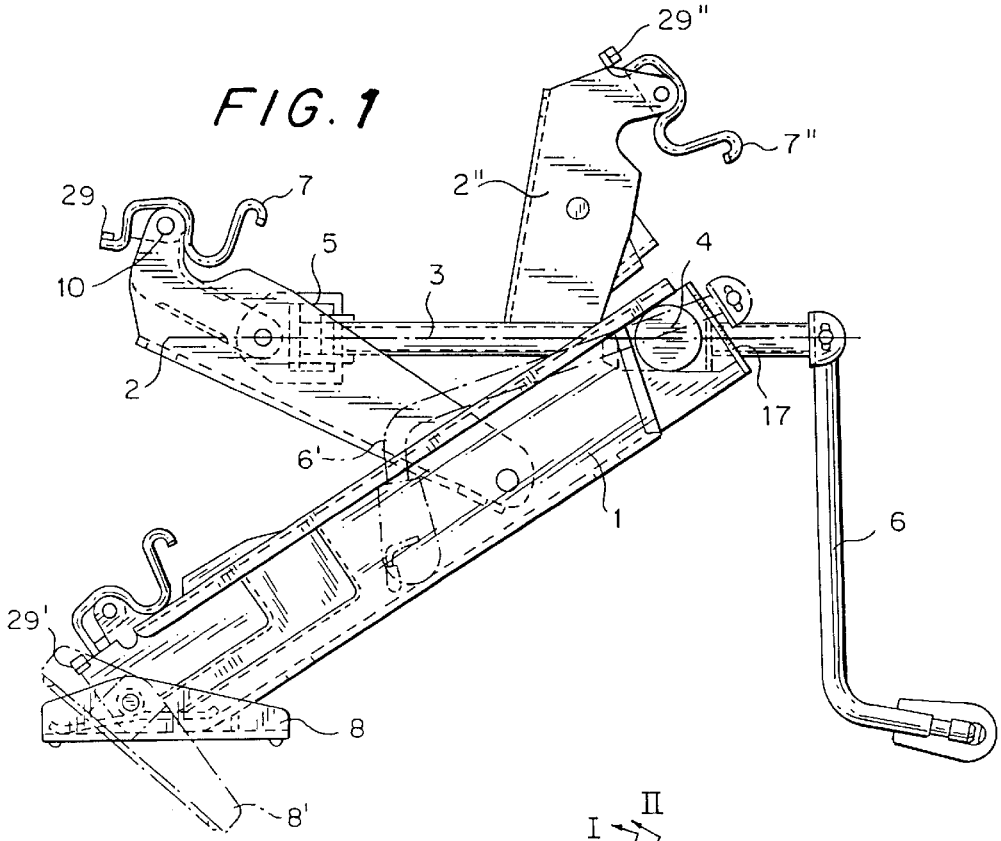
FIG. 1 shows an elevation of a Y-shaped jack including the details of this invention, with three arm positions and two positions for the supporting base and the crank winding handle.

FIG. 1 shows a Y-shaped jack in accordance with the invention, with the central body of the device (1) and the arm (2). The base (8) is on the lower section or base end of the body of the device (1), and above there is the reinforcement device (17) for the body and the position (4) of the nut.

The arm (2) rotates on the body (1), and at the free end of this the gripping device (7) rotates on the arm cross shaft, with its gripping fin (29). The arm (2) also connects with the bar (5), in turn connected to the spindle (3) passing through the nut (4) on the body of the device (1), finally connecting with the crank winding handle attachment (6).

When the crank winding handle is used to turn the spindle (3), the end of the arm (2) moves up or down in accordance with the direction of rotation, raising or lowering the load on the gripping device (7).

FIG. 1 shows three different positions for the arm (2) and its gripper (7). The upper drawing shows positions 2", 7" and 29", whilst the lower drawing shows positions 7' and 29', in which the gripping fin (29') rests on the edge of the body of the device (1) in the folded position.

We should also like to point out position 6' of the crank winding handle when the jack is folded, and position 8' of the supporting base rotating over the main body (1).

Figure 2:
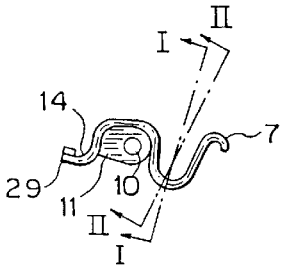
FIG. 2 is a side view of the jack's gripper as described in the invention.

In accordance with FIG. 2, we wish to point out the gripper (7) with its holed fins (11) and their holes at (10) for the shaft connected to the arm (2), and also the gripping fin (29) and the center of the gripper, with a corrugated profile whose sunken central section supports the edge of the car body.

Figure 3:
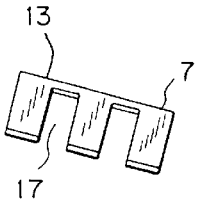
FIG. 3 shows the result obtained from the side view shown in FIG. 2, in accordance with section I—I.
Figure 4:
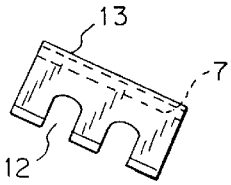
FIG. 4 shows the result obtained from the side view shown in FIG. 2, in accordance with section II—II.

FIGS. 3 and 4 show the left and right ends on both sides of the sunken central section. In both figures the upper support surface of the gripper (7) is numbered (13), together with the interior gaps (17 and 12) which lighten the unit with no loss to its strength.

Figure 5:
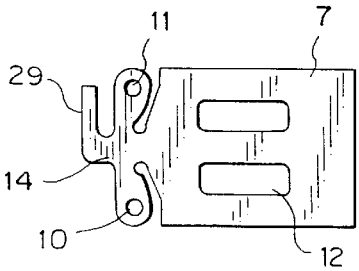
FIG. 5 shows a drawing of the gripper for a better understanding of its geometry.
Figure 5A:
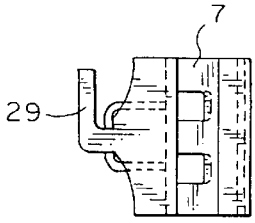
FIG. 5A is a top view of FIG. 2.

FIG. 5 shows the general extended shape of the gripper (7), its open windows or gaps (12), the fins (11) and the gripper fin (29). All three fins are connected to the central lengthwise section (14) of the body of the device.

We should also point out that when the gripper is folded into its corrugated shape, the fins (11) bend forward in parallel just below the upper surface (13). This surface remains as the same surface area, and the entire surface may be used to take the car body.

The gripper fin (29) is also perfectly defined as to its position and functional nature, as may be observed in the content of FIGS. 2, 5, 5A and 1.

Figure 6:
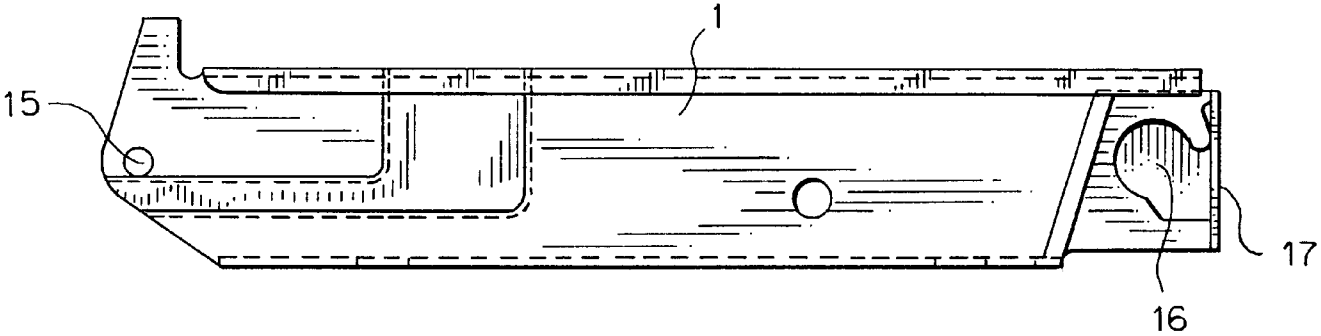
FIGS. 6 and 7 show two views of the body of the jack as described in the invention.
Figure 7:
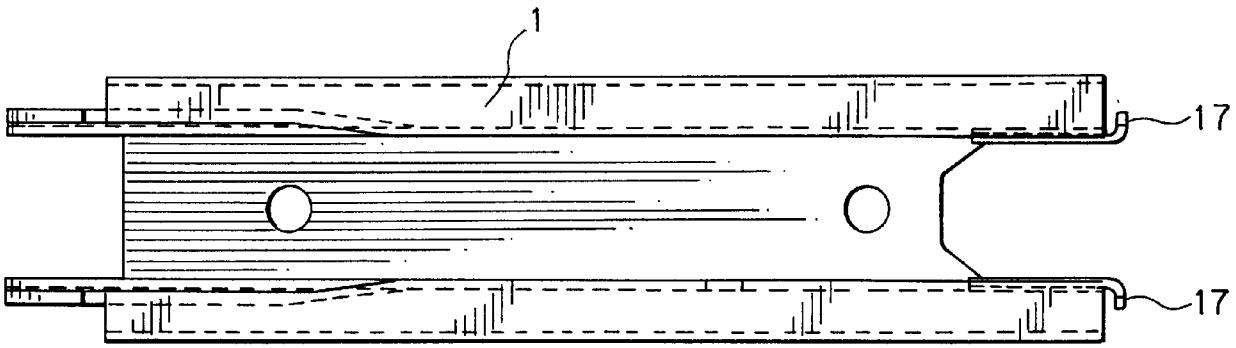

In FIGS. 6 and 7, the body is shown with its opposing screw fastener (15) at the lower end, for connection at the foot (8) of the jack.

At the opposite (upper) end, there is space in the flanges of the U section for a threaded spindle (3) in opposing holes (16) held by a nut (4). In the invention, the two opposing flanges (17) on the front surface of the body (1) are perpendicular to the length of the body. These flanges are an important reinforcement, providing resistance to large amounts of force.

Figure 10:
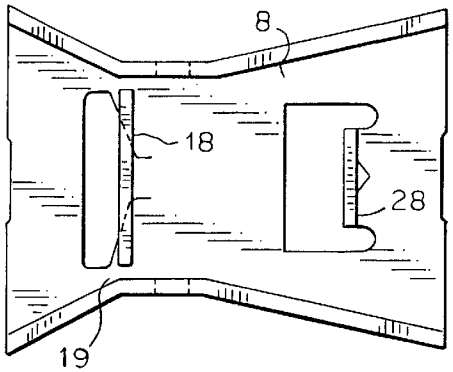
FIGS. 8, 9 and 10 are an elevation, a view of the m—m section of this elevation and an upper view of the above-mentioned elevation of the jack's base, as described in the invention.
Figure 9:
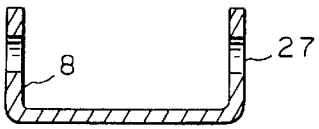
Figure 8:
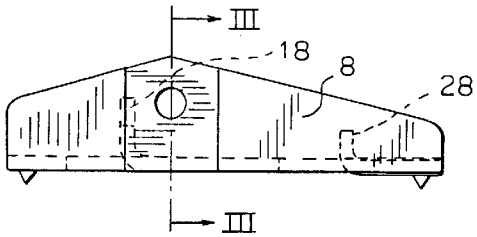

FIGS. 8, 9 and 10 show a U-cross section of the base (8), showing the projecting wall (28) at the bottom, restricting the rotation of the body of the device (1) over the base, and also the vertical wall (18) parallel to this wall and opposite it with respect to the aligned drill holes (27) hinging the body of the device (1).

The wall (18) creates spaces (19) between its ends and the vertical flanges of the base (1), and the body of the device (1) is located in and moves around these spaces, for complete control.

Figure 12:
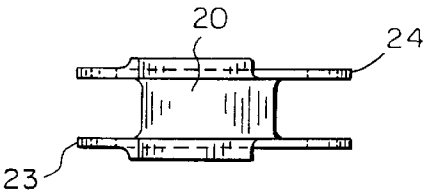
FIG. 12 shows a top view of the previous figure.
Figure 11:
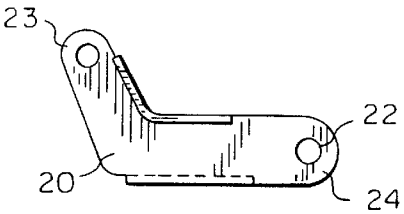
FIG. 11 shows an elevation of a preferable solution for the reinforcement device on the jack arm, as described in the invention.

FIGS. 11 and 12 show the elbow elevation of the reinforcement device (20), preferably used for this invention, with one end (23) for connection to the shaft through hole (10) of the gripper (7), and another end (24) for connection to the bar cross shaft through bar (5). This is carried out using the pairs of opposing holes (22) on each end.

The reinforcement device for the arm (2) may be, in general, any kind of sturdy material housed and secured between the flanges of this arm to make the assembly rigid, without any unnecessary and expensive increase in the thickness of the arm, particularly in this area of liability.

Figure 15:
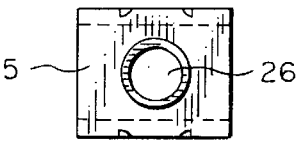
FIG. 15 is the result obtained from the top view of FIG. 13.
Figure 14:
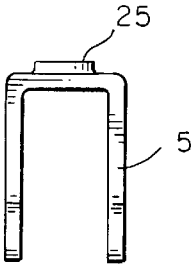
FIG. 14 shows a view from the left of the previous figure.
Figure 13:
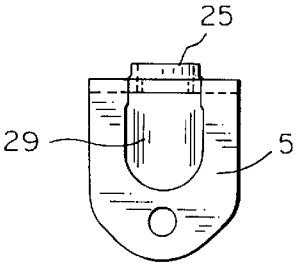
FIG. 13 shows an elevation of the device's bar, as described in the invention.

FIGS. 13, 14 and 15 show the U-shaped bar (5) and its neck (25) projecting from the base, moving the threaded spindle through the circular gap (26). They also show the notches or cavities (29) on the flanges of the bar.

Of the arm and the body of the jack device as described in the invention, at least one should preferably be a light material, aluminum.

The arm reinforcement devices may likewise be metallic or made from a light metal—aluminum, for example.

Once the function and the advantages of this invention have been described, its non-limitational nature should be made clear, and so any changes to shapes, materials or dimensions of its components shall in no way alter its essential function, provided these do not cause considerable variation to the assembly.

We claim:

1. A lightweight jack of the Y-type for raising an edge of a vehicle off the ground, the jack having a folded position and an unfolded position, the jack comprising:

a central body (1) including a base (8) to support the jack on the ground;

an arm (2), rotatably coupled to the central body, including on a free upper end thereof a gripper (7) matable with the edge of the vehicle;

a threaded spindle (3) linked to a bar (5) and a nut (4), the bar being connected to the arm via a bar cross shaft and the nut (4) being connected to the central body (1);

a crank winding handle (6) connected to the spindle (3) to rotate the spindle in order to raise or lower the free upper end of the arm (2) and the gripper;

the arm (2) comprising an arm cross shaft (9) disposed through transverse holes (10) of the gripper, whereby the gripper is rotatable about the arm;

the transverse holes (10) of said gripper (7) being through two holed fins (11) projecting from both sides of a central lengthwise section (14) of the gripper, the two holed fins being folded opposite each other and aligned to take therethrough the supporting arm cross shaft disposed between opposing walls of the arm (1);

the holed fins being located crosswise on the gripper not far from an outermost end thereof, folded on a horizontal plane over the arm cross shaft and being disposed completely below the surface of the gripper on which the vehicle rests;

a projection of the central lengthwise section (14) comprising at least one gripper fin (29), located on the gripper on a plane, said plane lying outside the plane of the holed fins (11), parallel to a disposition of the transverse holes (10) in said fins (11), and on a longitudinal axis of the gripper; whereby extra support is provided for said gripper (7) on the edge of support flanges of the central body (1) when the jack is in the folded position;

an internal reinforcement device (20) disposed inside the free upper end of the arm (2) between the arm cross shaft (9) of the gripper and the bar (5) secured crosswise between arm flanges of the arm;

the bar (5), through which the spindle (3) passes, including a U-shaped cross section and a cylindrical neck (25) from a base and towards the exterior, of sufficient length to accept the spindle therethrough;

the central body comprising an outermost gap (16) adjacent a connection to the nut (4), the central body comprising, on an outside of the outermost gap, two central-body flanges (17) parallel to each; said central-body flanges including a cross section with L-shapes oriented in opposing directions with respect to a longitudinal axis of the central body; exteriors the two central-body flanges defining a portion of a surface of the central body;

a support base (8) including a U-section and a bottom comprising a vertical cross wall (18) of a certain height, the support base being interrupted at lengthwise ends thereof at a certain distance from U-flanges of the U-section, thereby creating two spaces (19) which accept a thickness of the central body (2) of the jack, and wherein the vertical wall is disposed on a lateral plane with respect to a vertical plane containing attachment holes (27) to which the central body is attached.

2. The lightweight jack according to claim 1, wherein the interior reinforcement device (20) is generally U-shaped in a cross section across the longitudinal axis of the central body and comprising elbow flanges such that the reinforcement device (20) is generally elbow-shaped in a side elevation, the elbow flanges (23, 24), comprising pairs of opposing aligned holes (21, 22) which connect with the arm cross shaft of the gripper and the bar cross shaft of the bar.

3. The lightweight jack according to claim 1, comprising a pair of gripper fins (29) which jut out on both sides of the central lengthwise section (14).

4. The lightweight jack according to claim 1, wherein the central-body flanges (17) are vertical and perpendicular to a longitudinal extension of the central body (1).

5. The lightweight jack according to claim 1, wherein the central-body flanges (17) are inclined with respect to a longitudinal extension of the central body (1).

6. The lightweight jack according to claim 1, wherein the bar (5) comprises bar flanges and the bar flanges include two aligned windows or notches (29), parallel to an alignment of supporting-pin holes housing a supporting pin towards the arm flanges.

7. The lightweight jack according to claim 1, wherein at least one of central the body (1) and the arm (2) comprises a light metal.

8. The lightweight jack according to claim 7, wherein the light metal comprises aluminum.

9. The lightweight jack according to claim 1, wherein the reinforcement device (20) comprises aluminum.

10. The lightweight jack according to claim 1, wherein the reinforcement device (20) comprises steel.

11. A lightweight jack of the Y-type for raising an edge of a vehicle off the ground, the jack being movable between a folded position and an unfolded position, the jack comprising:

a central body (1) having a base end to support the jack on the ground;

an arm (2) having a free upper end and a constrained lower end, the lower end of the arm being rotatably coupled to the central body at a first pivot point intermediate along a central-body length of the central body;

a gripper (7), matable with the edge of the vehicle, rotatably coupled to free upper end of the arm via a cross shaft (9) disposed through transverse holes (10) of the gripper;

a bar (5) rotatably coupled to the arm, via a bar cross shaft, at a second pivot point intermediate along an arm length of the arm;

a nut (4) rotatably connected to the central body (1) at a third pivot point adjacent an end of the central body opposite to the base end;

a threaded spindle (3) linked to the bar (5) and threaded through the nut (4), whereby a rotation of the spindle changes a distance between the bar and the nut;

a crank winding handle (6) coupled to the spindle (3) to rotate the spindle, whereby the free upper end of the arm (2) and the gripper are raised and lowered when the base end is on the ground; and an internal reinforcement device (20) disposed inside the arm between the arm cross shaft and the bar cross shaft.

12. The lightweight jack according to claim 11, wherein the base end of the central body further comprises a base (8) rotatably coupled to the base end.

* * * * *